United States Patent [19]

Landgraf et al.

[11] 4,447,991

[45] May 15, 1984

[54] METHOD FOR GRINDING OR POLISHING CURVED SURFACES OF SOLID BODIES AND APPARATUS FOR CARRYING OUT THIS METHOD

[75] Inventors: Wolfgang Landgraf; Walter Scharf, both of Zwiesel; Heinrich Simon, Rabenstein, all of Fed. Rep. of Germany

[73] Assignee: Schott-Zwiesel-Glaswerke Aktiengesellschaft, Zwiesel, Fed. Rep. of Germany

[21] Appl. No.: 444,186

[22] Filed: Nov. 24, 1982

Related U.S. Application Data

[63] Continuation of Ser. No. 204,368, filed as a PCT DE 79/00151, Dec. 20, 1979, published as WO80/01261, Jun. 26, 1980, § 102(e) date Aug. 18, 1980, abandoned.

[30] Foreign Application Priority Data

Dec. 23, 1978 [DE] Fed. Rep. of Germany ..... 2855895

[51] Int. Cl.[3] ..... B24B 5/00

[52] U.S. Cl. ..... 51/161; 51/283 R; 51/227 R

[58] Field of Search ..... 51/227 R, 154, 161, 51/162, 283

[56] References Cited

U.S. PATENT DOCUMENTS

| | | | |
|---|---|---|---|
| 1,467,517 | 9/1923 | Taylor . | |
| 2,612,729 | 10/1952 | Walley | 51/154 |
| 2,664,679 | 1/1954 | Kelly | 51/161 |
| 2,715,803 | 8/1955 | Bronson | 51/124 |
| 3,110,988 | 11/1963 | Boettcher | 51/131.2 |
| 3,146,552 | 9/1964 | Croshaw | 51/154 |
| 3,355,840 | 12/1967 | Bonning | 51/227 R |

FOREIGN PATENT DOCUMENTS

| | | |
|---|---|---|
| 326638 | 9/1920 | Fed. Rep. of Germany . |
| 345618 | 12/1921 | Fed. Rep. of Germany . |

*Primary Examiner*—Harold D. Whitehead
*Attorney, Agent, or Firm*—Finnegan, Henderson, Farabow, Garrett & Dunner

[57] ABSTRACT

The invention relates to a method for grinding, polishing etc. curved surfaces of non-metallic solids, in particular glass bodies using a tool adapted at least in part to the surface to be machined and which moves relatively to the body to be machined while being compressed. This tool elastically follows the solid to be machined, and flowable grinding and/or polishing means are continuously supplied to the work space between tool and solid. The apparatus includes a rotating disk for seating and fastening the solid, elastically displacable, rigid tool presses at least against one part of the surface of the solid. Preferably it is the solid which is rotated while the tool is spatially fixed in elastically displaceable manner and is kept compressed in places against the solid.

15 Claims, 6 Drawing Figures

METHOD FOR GRINDING OR POLISHING CURVED SURFACES OF SOLID BODIES AND APPARATUS FOR CARRYING OUT THIS METHOD

This is a continuation of application Ser. No. 204,368, filed as a PCT DE79/00151, Dec, 20, 1979, published as WO80/01261, Jun. 26, 1980, §102(e) date Aug. 18, 1980 and now abandoned.

BACKGROUND

The invention relates to a process for grinding, polishing etc. curved surfaces of non-metallic solids, in particular glass bodies, using a tool adapted at least in part to the surface to be machined and moving relative to the body to be machined while under compression, and the invention also concerns an apparatus for carrying out this method.

German Pat. No. 326 638 discloses a method similar to the above-designated one, wherein the conical sealing surfaces of the necks of bottles and of bottle stoppers made of crystal or glass are being ground to shape. The tool used for grinding to shape consists of a lengthwise slotted hollow cone which is wound up from a strip of sheet metal at the instant use, is drawn on a spindle and set into rapid rotation. The water-mixed grinding material is introduced into the neck of the bottle after the sheet metal wound into a hollow cone is drawn around the spindle and before the tool is set into rotation. The workpieces to be ground and accordingly also the tool used exhibit only one curvature and it is impossible to grind complex shapes using the known method, for instance not the feet, the stems or the base plates of stemmed glasses. On the contrary, the known tool is deliberately designed as a hollow cone of constant wall thickness so that both the stopper and also the neck are of the same conical shape. Furthermore turning of the tool takes place in a conventional manner, the workpiece being kept fixed. The workpiece is supported in a rigid manner, so that the complex shapes fed from a glass press such as the bottom plate and the stem of a stemmed glass cannot be made by the known method even if the tool contour were to be provided with more than one curvature. Furthermore no provision is made for the continuous feed of grinding means.

When fabricating stemmed glasses, either the stem is pressed on the blown cup or the cup is blown on the pressed goblet foot.

Fabrication of the stem may take place in two or more parts. Accordingly more or less pronounced lengthwise seams are created when pressing, which are especially visible at the bottom plate of the stem. Manufacture by pressing is economical and therefore is especially suited for mass production. Still the desire persists to improve its quality. Therefore, in order that the necessarily bossy longitudinal seam at least be made to be less obvious to the eye, the bottom plate has been been made into a polygonal shaped cross-section—and sometimes also the stem—, which extends outwardly as far as into the bottom plate. The division joint of the mold then is directly on the edge of the polygon. If a stem with symmetry of rotation is desired, this division joint can no longer be optically masked.

Processes for circumventing this drawback are already known, in which the stemmed glass is so shaped that the stem terminates in a tulip shape pressed against it. After the stem is set against the cup, this tulip is heated until plastic and then is shaped by means of correspondingly designed carbon jaws and rotated to be formed into the bottom plate. This method suffers from the drawback that the bottom plate thereby receives concentric and mostly unesthetic bands.

There is in fact the possibility to remove the pressing seam at the bottom plate by grinding—partly by hand—and by subsequent polishing. But this process, which uses a revolving grinding means, is very costly because of the manual labor.

To-date, mechanizing this manual process had to fail on the following grounds: cups and stems for stemmed glasses are fabricated in the plastic state without milling by means of blowing or pressing. Such a manufacture inherently and in contrast to the cutting methods involves a larger tolerance of several tenths of a millimeter which is noticeable with respect to circularity, coaxiality and angular offset of the cup axis and stem axis. Therefore it is impossible to tightly clamp a glass at the stem and/or the cup so that it will rotate precisely circularly. A profiled grinding disk set on the upper side of the bottom ought to grind off from one side the asymmetries until all the seams are ground away. But by this account an inappropriate large amount of glass will be taken off and the time of processing is disadvantageously long.

Now ways already have been sought to remove the seam using grinding belts of which the reversing roller must be guided over the seam. Such methods however failed due to the high economic expenditures regarding machinery and tools.

Lastly a process and apparatus for grinding shallow grooves into ceramic workpieces are known from German Offenlegungsschrift No. 2 529 438. It was found that when making the grooves by sawing, the vibrations of the sawing means and the loss of crumbling of the very brittle ferrite material resulted in inaccuracies. The known process however remains a sawing process, in which in fact a wire sawing machine is used in which taut wires are braced on a drum. Using a grinding means, the workpiece to be processed is pressed against the wires clamped at mutual spacings on the drum periphery. The particular metal wire is clamped in such a manner in a peripheral groove of the drum that it projects with part of its cross-section from the surface and hence carries out the sawing process in the workpiece pressed against the drum. This known method provides no guidance regarding the grinding or polishing of surfaces, especially not for complex profiles such as the stem and base plates of a glass foot.

It is therefore the object of the invention to apply the known process initially cited also to the grinding of such surfaces which are curved at least in two directions.

This problem is advantageously resolved by the invention in that the tool elastically follows the solid to be machined and in that flowable grinding and/or polishing means are continuously fed into the work space between tool and solid. This method for the first time creates a way by means of which the above described seams generated during pressing and located on the glass bodies can be removed, to which end a shaping tool moving relatively to the glass body is made to operate with a continuous feed of grinding means. The new process surprisingly enables removing the seams in less than 30 seconds, preferably in less than 15 seconds. Fundamentally the previously conventional procedure was abandoned as regards removal of material, namely to use elastomeric, elastic tools, for instance rotating disks or the like, which are supported in rigid manner.

According to the invention, the tool elastically follows the solid to be worked on. Because of the elastic support of the tool, which may be for instance a steel shaping means, it is possible to remove in a very effective manner and in a short time, in about 15 seconds, longitudinal seams at the feet of stem glasses to such an extent that it is rather difficult or impossible to notice them optically. Thereby the mass-produced glass, which may have been produced in fully automated manner, is endowed with a quality that previously could be achieved only by manual processing. The new process opens a higher-grade market to a machine-made glass even though the economic advantages of pressing the lower part of the glass have not been abandoned. Pressing does offer many design possibilities, low manufacturing costs, and smooth surfaces. The grinding only partly roughens the surfaces which can be returned to their smooth nature in the shortest time by polishing.

The great difficulties with the known processes and the unsuccessful experiments in the plants can be explained also by the fact that the seam generated when pressing is not a burr but a step, whereby a short-term grinding by means of fine grinding belts of which the guide rollers are guided along the contour of the foot with little compression do not bring about the desired effect.

SUMMARY OF THE INVENTION

The inventors on the other hand followed an unusual approach, namely to move the tool under forceful compression but nevertheless elastically supported with respect to the glass body. It is especially advantageous in the sense of the invention that the solid, i.e. the glass body, be rotated and that the tool while elastically supported be spatially fixed and be kept compressed in places against the solid. While the tool might be simultaneously pressed against the entire surface of the body to be worked, partial contact is however adequate due to the rotational motion, whereby the advantage is obtained that the tool becomes smaller and can be better handled. Furthermore the moved mass is smaller. Also, it is possible to feed the grinding means through channels in the tool to the working space.

It is especially appropriate to periodically exert a compression on the tool in conformity with the invention. This step too results in a better feed of the grinding means which is either supplied through conduits, brushes, sponges or channels to the work space.

The apparatus for implementing the process is characterized by a rotary disk for seating and fastening the solid and an elastically supported tool pressed against at least a part of the surface of the solid. By these characteristics the tool gives way in desired manner in all the coordinate directions and nevertheless exerts an appreciable compression on the surface to be worked, so that the seam which cross-sectionally is a step and to the observer appears as a burr can be removed in a very short time. As the surfaces of workpiece and tool optimally adapt to each other at any instant of the rotation, and as thus there are no peak stresses as would be the case for rigid support, both the tool and the glass body to be worked are extensively protected from abuse in spite of the strong compression.

Clearly a tool with such characteristics can have the most diverse contours, that is, the invention allows grinding or polishing surfaces which are curved in more than two directions. Thus for the first time a method and apparatus have been created to process machine-made, for instance pressed stemmed-glass feet into high-grade ware.

In an advantageous further development of the invention, the tool forms a rigid part with at least two curvatures in the final contour. Obviously a rigid part which may be made for instance of steel can be shaped in such a complex geometry by milling or also by pressing or casting that any conceivable profile is obtained. When the rigid part acting as tool has a complex concave shape, which corresponds to the convex contour of a workpiece to be processed, it is clear that all the desired processing can be carried out with surprising efficacy and in a short time.

It is also advantageous according to the invention to provide channels in the tool for the feed of grinding means. Because the tool essentially is kept spatially fixed, liquid grinding means can be continuously pumped into the work space by means of hoses and conduits.

It is also appropriate that in the invention the rotary disk be designed as a driven cup-wheel and comprises a center support for the erection of the solid which can be tightened in place by a clamping means. A substantial supply of grinding means may be kept in the cup wheel in an annular recess around the center support, said supply then being feedable over a short path to the work space. The clamping means for instance may be a pneumatic cylinder which by means of an elastic, rotatably supported compression piece made of rubber, plastic or the like presses the workpiece, for instance a stemmed glass, softly from the top on the center support. The freeing can be controlled in preprogrammed periodic intermittent manner.

In an advantageous further development of the invention, the tool is held in position by compression cylinders and two rods at an angle to each other and each with an elastic spacer. These cylinders too can be driven pneumatically and periodically controlled in preprogrammed manner whenever for instance following the fastening of a glass body to be worked, the tool is moved to the surface to be worked and lifted off again after the processing.

The tool partly encloses the workpiece, whereby the tool cannot be forced away.

The pneumatically driven cylinders thereby allow a pneumatically controlled compression. The pneumatics further offers the advantage that the tool can get out of the way when a projecting unevenness is passing by, because it is possible to push the piston rods for a short time some distance into the cylinder while increasing the air pressure.

The tool is appropriately hardened so that the removal of material preferably take place at the workpiece rather than at the tool.

Further advantages, characteristics and applications of the present invention flow from the description below in relation to the drawings.

DESCRIPTION OF THE PREFERRED EMBODIMENTS

Figure 1:
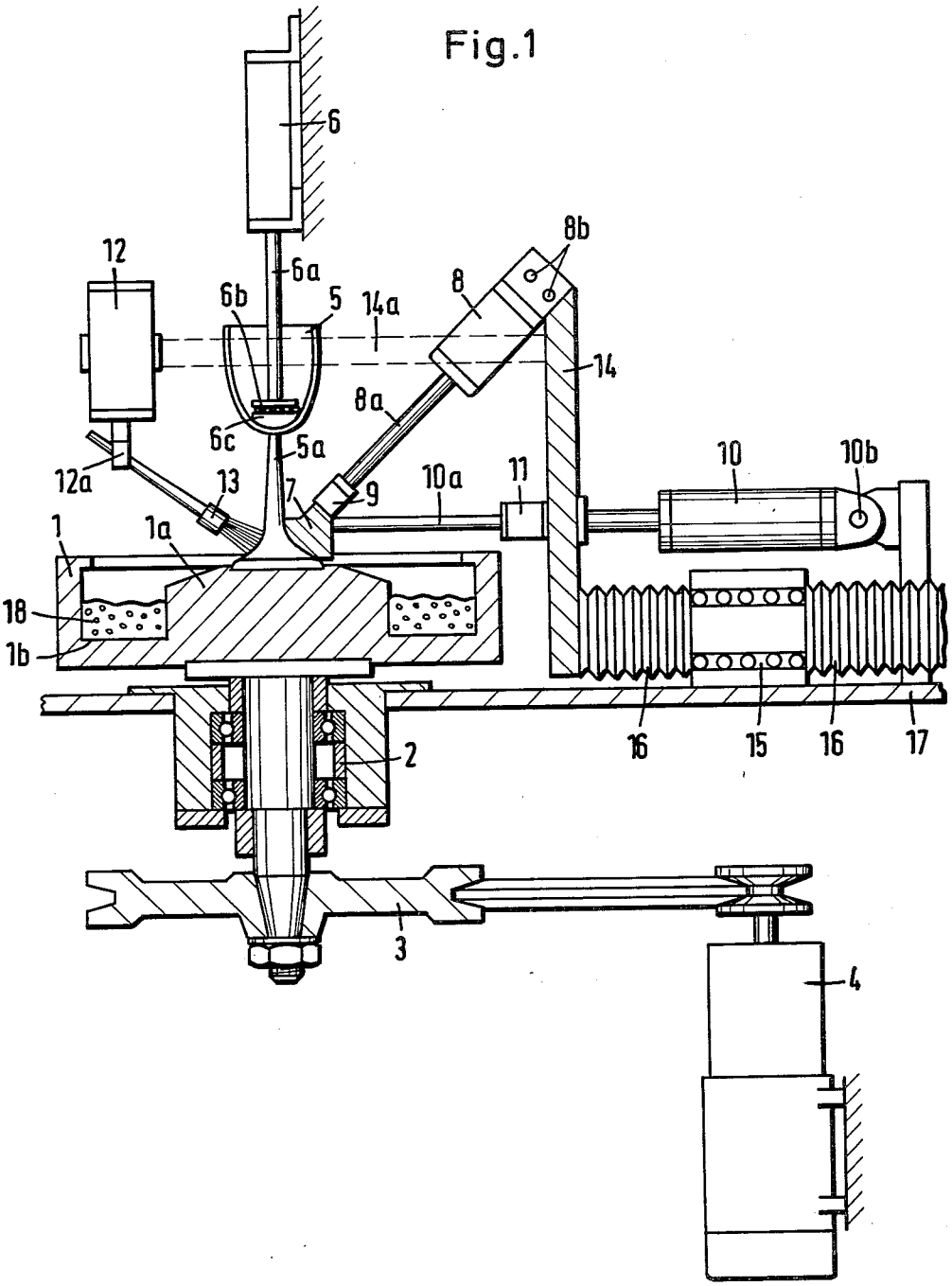
FIG. 1 shows a fractional and partly schematic cross-sectional elevation of a preferred embodiment of an apparatus for grinding or polishing a glass body in the form of a stemmed glass.

FIG. 1 shows a rotating disk 1 designed as a cup wheel with a center support 1*a* as the workpiece holder and with an annular channel 1*b* concentric with the center support 1*a*, being driven by motor 4 by means of a pivot bearing 2 and a V-belt pulley 3.

In another embodiment not shown here the revolving disk 1 with the center support 1*a* is divided into two separately rotating machine parts. On the other hand the the center part, the workpiece holder 1*a*, is provided with a bearing, and on the other the annular channel 1*b* is supported separately and driven separately. The said channel can for instance revolve at a lesser angular speed than the center support.

A centering clearance is provided in the middle of the center support 1*a* acting as the workpiece holder, said clearance seating the foot 5*a* of the stemmed glass 5, this foot required to be worked on. The stemmed glass 5 is held under compression from above by means of a cylinder 6 mounted to the machine frame, a piston rod 6*a* and a compression piece which is stationary by means of pivot bearing 6*b* with respect to the clamping piece 6*c* that revolves along. In this manner the stemmed glass 5 may be compressed more or less strongly when being centered on center support 1*a* by means of the particular air compression that was set and using the cylinder 6.

Figure 2A:
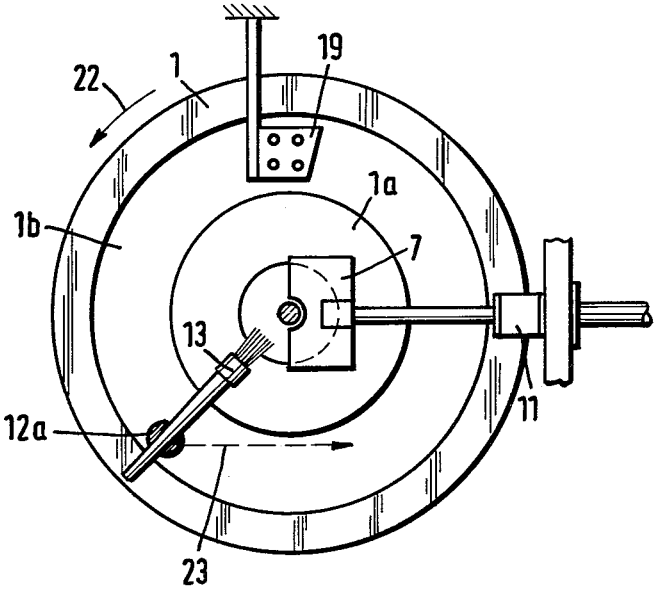
FIG. 2*a* is the top view of the rotating disk designed as a cup wheel when in the operational state, for instance for grinding.
Figure 2B:
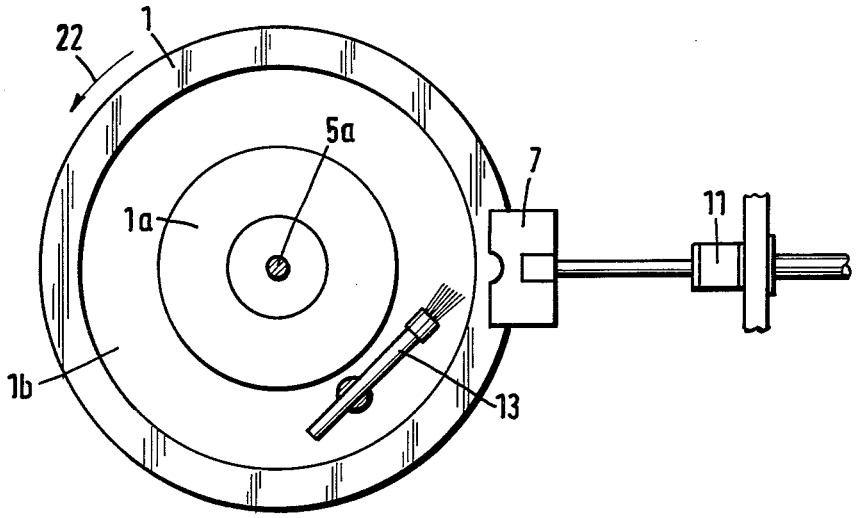
FIG. 2*b* is the same view as FIG. 2*a* but for the tool retracted from the workpiece.

The tool is shown in section in FIG. 1 and denoted by 7. FIG. 2*a* and 2*b* show a top view of the tool 7, the same design of tool 7 being used in FIG. 1 and 2, the top view showing a tool 7 half enclosing the workpiece 5*a*.

Figure 3A:
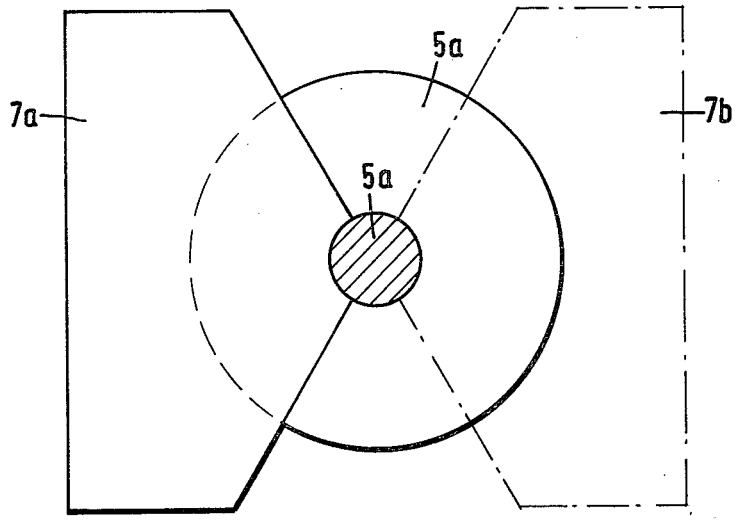
FIG. 3*a* is a schematic section through the foot of a stemmed glass parallel to the bottom plate with a view of the tool in the operational position.
Figure 3B:
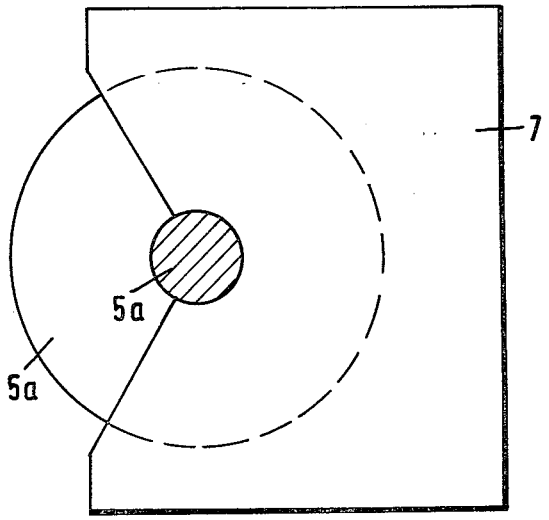
FIG. 3*b* is the same view as FIG. 3*a* but showing another design of the tool, &

FIG. 3*a* shows another embodiment of a tool 7*a* in the left-hand part, enclosing the workpiece 5*a* only for an angular range from 100° to 120°. This allows mounting oppositely a similar tool 7*b* as indicated by the dash-dot lines. The opposing pressures from both tools 7*a* and 7*b* can be set to be balancing FIG. 3*b* shows a further embodiment of the tool 7 which encloses the foot 5*a* of the stemmed glass 5 by an angular range exceeding 180°, namely about 200°.

Figure 4:
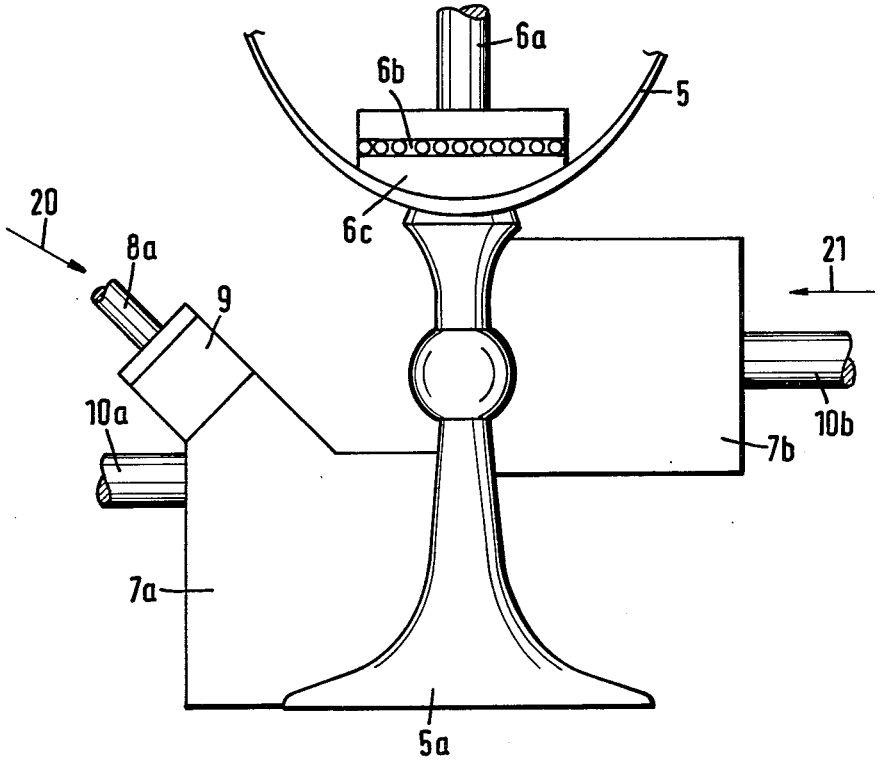
FIG. 4 is the schematic elevation of a partly shown stemmed glass with tools of various embodiments in the operational position.

Lastly FIG. 4 shows a further embodiment of two tools 7*a* and 7*b* which work from different heights on the foot 5*a* of the stemmed glass 5 from opposite sides. The tool 7*a* is compressed in direction of arrow 20 and tool 7*b* in the direction of arrow 21 on the foot 5*a* from opposite directions. The resulting direction of compression 20 or 21 is determined depending on the machine design, where appropriate by the direct pressure from a piston rod 8*a*, 10*a* or 10*b* of which the compression can be separately pneumatically controlled.

It will be observed with respect to FIG. 1 that the tool 7 is held in place by a compression cylinder 10 through a horizontally arranged rod 10*a* and an elastic spacer 11 and by compression cylinder 8 through a rod 8*a* and an elastic spacer 9. It is self-evident that depending on the compressions, the resultant will be more or less in the horizontal or vertical, whereby the compression is directed as desired against that part of the foot 5*a* where especially substantial amounts of material are to be removed. For instance the upper compression may be selected somewhat larger. Preferably the specific, that is, the compression force per area, will be kept constant.

Tool 7 is elastically compressed by the pneumatic pressure in the compression cylinders 8,10 against the foot 5*a*. When a projecting irregularity on foot 5*a* moves toward the tool 7, tool 7 moves out of the way due to the piston rod 8*a* or 10*a* being forced into cylinder 8 or 10 respectively.

By appropriately controlling the pneumatic pressure in the compression cylinders 8 and 10, it is possible to obtain a resultant such as is shown for example in FIG. 4 by arrow 20 of compression force and direction of compression whereby the removal of material from the workpiece takes place only in such a desired direction, and in such uniform manner that the workpiece contour practically remains unchanged. It is clear per se that several piston rods 8*a*, 10*a* can be provided and that these can be arranged at the most obverse angles in order to precisely set the resultant, that is the pressure in amount and direction, by means of the pressure level in the compression cylinders 8 and 10, said pressure levels being separately adjustable.

The compression cylinder 8 is mounted to the frame 14 by means of bolts 8*b*, the spacer 11 with the rod 10*a* also being mounted to said structure. The piston rod of the compression cylinder 10 is mounted on the side of the frame 14 opposite to the spacer 11, this compression cylinder 10 being fastened by a bolt 10*b* to the base plate 17 of the machine. The frame 14 as shown in FIG. 1 can be moved to the left and right by actuating the compression cylinder 10, by using a thrust bearing 15 secured against rotation; the protective bellows 16 is shown next to said thrust bearing for the purpose of preventing penetration by dirt, for instance grinding means, into an (omitted) groove support. Rods 8*a* and 10*a* move together with frame 14 and hence the tool 7 moves also relatively to the foot 5*a* of the stemmed glass 5 held on the center support 1*a*. Furthermore cylinder 12 mounted by brace 14*a* to the frame 14 moves together with this frame. A brush 13 is mounted by means of an adjustable clamping or screw system 12*a* at the free end of the piston rod of said cylinder 12. Grinding means flow from said brush 13 on the foot to be worked on during the grinding process for the representations of FIG. 1 and 2*a*. As regards the representation of FIG. 2*b*, due to the motion to the right by the frame 14 together with the part secured to it, the cylinder 12 together with the brush 13 also has moved to the right and then is located above the annular channel 1*b* filled with grinding means 18.

FIG. 2*a* further shows an obliquely arranged spatula 19 with through-holes. It is used to homogenize the grinding means in annular channel 1*b*. As shown in the schematic representation, it is spatially fixed, while the grinding means 18 together with annular channel 1*b* rotates in the sense of the curved arrows in FIG. 2*a* and 2*b*. Deposition of the heavy components of the grinding means at the bottom of annular channel 1*b* is thus advantageously prevented by the spatula 19.

As regards the embodiment shown in FIG. 4, the tool 7*a* may be made for instance of hardened steel and the oppositely mounted tool 7*b* might consist of elastic plastic as a counter-pressure piece. The above described embodiments show that the tools 7*a*,7*b* where appropriate can be forced from different directions and at different times against the foot 5*a*, that is, the workpiece to be processed.

In operation, that is, when grinding off the rib-shaped step at the foot 5*a* of the stemmed glass 5, the grinding means first is made to fill the annular channel 1*b* and thereupon the stemmed glass 5 is set down and clamped by actuating the cylinder 6 and using the clamping piece 6*c*. Thereupon the brush 13 filled with grinding means is moved out of the annular channel 1*b* by actuating the cylinder 12, whereby the state as seen from above in FIG. 2*b* is obtained. Next the compression cylinder 10 is actuated so that the frame 14 moves to the left and the operational state shown in FIG. 1 and 2*a* is reached. By properly adjusting the pressures in the compression cylinders 8 and 10, the compression resultant is obtained as exerted by the tool 7 on the foot 5*a*. The motor 4 drives the foot 5*a* for about 10 seconds so it rotates under the tool 7, whereupon the unesthetic step essentially has been ground off. The compression cylinders 8, 10 are actuated so that the tool 7 together with brush 13 can be moved along the dashed arrow 23 in FIG. 2*a* into the position of FIG. 2*b*. Thereupon cylinder 12 is actuated, brush 13 dips into the grinding means 18 in the annular channel 1*b*, fills up, and the operational cycle starts over.

It is to be understood that the grinding means 18 is continuously moved through the passage-holes of the spatially fixed, obliquely mounted spatula on account of the rotation of the annular channel 1*b*, whereby the heavy components cannot settle on the bottom of the annular channel, and thereby ensuring homogeneization of the grinding means.

We claim:

1. Apparatus for removing a step-like ridge from, and for simultaneously grinding, an extended portion of the surface of a substantially rotationally symmetric stem of a glass or ceramic article, which surface is curved both laterally and longitudinally, comprising:

(a) means for rotating the article about the axis of symmetry of said stem, said means including means for securely holding the article as it is rotated;

(b) at least one rigid tool having a rigid, extended work surface curved to complement said lateral and longitudinal curvature of a sector of said extended portion of the surface of said stem for removing the step-like ridge from, and for simultaneously grinding, said extended portion, the boundary of said work surface defining a sector delimited by: (i) the arc of a first circle intercepted by two radii thereof, (ii) the arc of a second, concentrically situated circle intercepted by said two radii, and (iii) said two radii, the angle subtended by said two radii comprising at least about 100°; and (c) means operatively connected to said tool for pressing said tool work surface against said extended portion of the surface of said stem, said means for pressing being positioned in a plane extending radially with respect to the axis of rotation of the stem to provide a resultant force in said radial plane sufficient to accomplish the desired ridge removal and grinding when the article is rotated, said means for pressing including elastically displaceable support means for displacing the tool during ridge removal and grinding in response to any asymmetry of said surface.

2. Apparatus as claimed in claim 1, wherein said means for pressing comprises at least one rigid member and at least one elastically displacable compression cylinder operatively connected thereto for providing said resultant force and for providing at least a portion of said displacement of the tool during grinding.

3. Apparatus as claimed in claim 2, wherein said means for pressing comprises at least two rigid members disposed at an angle to one another and at least two elastically displacable compression cylinders, each operatively connected to at least one of said rigid members, the angular relationship between said rigid members and the magnitude of the respective forces exerted by the compression cylinders being adapted to provide said resultant pressing force.

4. Apparatus as claimed in claim 2, wherein said means for pressing includes at least one elastic spacer connected to said rigid member for providing a portion of said displacement of the tool during grinding.

5. Apparatus as claimed in claim 1, further comprising means for supplying grinding material to the space between the tool work surface and the surface of the article during grinding, said means including a plurality of channels in the tool work surface for conducting said grinding material to the surface of the article.

6. Apparatus as claimed in claim 5, wherein said means for pressing includes means for periodically pressing said tool work surface against said extended portion of the article surface.

7. Apparatus as claimed in claim 5, wherein said means for rotating the article includes a rotatable cup wheel having a central support area for supporting the article, and wherein said means for securely holding the article as it is rotated includes a rotatable clamping means for applying sufficient clamping pressure to the article to hold it securely against said central support area during grinding.

8. Apparatus as claimed in claim 7, wherein said means for supplying grinding material includes a container for said material and a movable brush operatively connected to said tool through linkage means for dipping said brush into said material in said container and supplying said material to the space between the tool work surface and the surface of the article.

9. Apparatus as claimed in claim 8, wherein said container for the grinding material comprises an annular channel in said rotatable cup, said channel being situated concentrically around said central support area.

10. Apparatus as claimed in claim 9, further comprising perforated spatula means angularly fixed in said channel for mixing the grinding material as said cup wheel is rotated.

11. Apparatus as claimed in claim 1, wherein two of said rigid tools are provided, said tools being situated on opposite sides of the article during grinding.

12. Apparatus as claimed in claim 1, wherein said tool work surface comprises a sector extending over an angle of from about 100° to about 180°.

13. Method for removing a step-like ridge from, and for grinding, and extended portion of the surface of a substantially rotationally symmetric stem of a glass or ceramic article, which surface is curved both laterally and longitudinally, comprising:

(a) rotating the article about the axis of symmetry of said stem and securely holding the article as it is rotated;

(b) providing at least one rigid tool having a rigid extended work surface curved to complement said lateral and longitudinal curvature of a sector of said extended portion of the surface of said stem for removing the step-like ridge from, and for simultaneously grinding, said extended portion, the boundary of said work surface defining a sector delimited by: (i) the arc of a first circle intercepted by two radii thereof, (ii) the arc of a second, concentrically situated circle intercepted by said two radii, and (iii) said two radii, the angle subtended by said two radii comprising at least about 100°;

(c) pressing said tool work surface against said extended portion of the surface of said stem with a resultant force lying in a plane extending radially with respect to the axis of rotation of the stem, said force being sufficient to accomplish the desired ridge removal and grinding when the article is rotated;

(d) elastically displacing the tool during ridge removal and grinding in response to any asymmetry of the surface of said stem; and (e) supplying grinding material to the space between the tool work surface and the stem surface during grinding.

14. Method as claimed in claim 13, wherein said pressing is achieved by applying at least two separate forces to said tool, the magnitude of said individual forces and their angular relationship to one another being selected to provide said resultant pressing force for grinding.

15. Method as claimed in claim 13, wherein said pressing takes place periodically.

* * * * *